US005807597A

United States Patent [19]

Barnes et al.

[11] Patent Number: 5,807,597

[45] Date of Patent: Sep. 15, 1998

[54] PROCESS FOR STORING AND COOKING AN OMELET

[75] Inventors: Robert C. Barnes, Hackettstown; W. David Snyder, Andover; Nancy J. K. Cesari, Annandale, all of N.J.

[73] Assignee: Nabisco Technology Company, Chicago, Ill.

[21] Appl. No.: 943,813

[22] Filed: Oct. 3, 1997

Related U.S. Application Data

[62] Division of Ser. No. 512,692, Aug. 10, 1995, Pat. No. 5,674,546.

[51] Int. Cl.[6] ..... B65D 81/34; B65D 81/32

[52] U.S. Cl. ..... 426/234; 426/394; 426/407; 426/614; 426/398

[58] Field of Search ..... 426/120, 113, 426/124, 112, 107, 118, 394, 234, 407, 614, 398; 220/522, 528, 23, 86; 229/403

[56] References Cited

U.S. PATENT DOCUMENTS

| | | |
|---|---|---|
| 2,076,132 | 4/1937 | Rose . |
| 2,591,578 | 4/1952 | McNealy et al. . |
| 2,739,751 | 3/1956 | Bailey . |
| 2,858,224 | 10/1958 | Darrah . |
| 3,251,697 | 5/1966 | Lineweaver et al. . |
| 3,417,895 | 12/1968 | Penton . |
| 3,482,729 | 12/1969 | Penton . |
| 3,547,658 | 12/1970 | Melnick . |
| 3,565,638 | 2/1971 | Ziegler et al. . |
| 3,659,584 | 5/1972 | Doyle . |
| 3,746,158 | 7/1973 | Connick . |
| 3,911,144 | 10/1975 | Strong et al. . |
| 4,018,904 | 4/1977 | Muraoka . |
| 4,233,325 | 11/1980 | Slangan et al. . |
| 4,596,713 | 6/1986 | Burdette . |
| 4,803,088 | 2/1989 | Yamamoto et al. . |
| 4,808,425 | 2/1989 | Swartzel et al. . |
| 4,874,618 | 10/1989 | Seaborne et al. . |
| 4,883,935 | 11/1989 | Fairchild et al. . |
| 4,910,036 | 3/1990 | Rapp . |
| 5,077,066 | 12/1991 | Mattson et al. . |
| 5,096,728 | 3/1992 | Rapp . |
| 5,266,338 | 11/1993 | Cascione et al. . |
| 5,363,982 | 11/1994 | Sadlier . |
| 5,384,139 | 1/1995 | Vasseneix . |
| 5,447,236 | 9/1995 | Perry et al. . |

*Primary Examiner*—Steven Weinstein
*Attorney, Agent, or Firm*—St. Onge Steward Johnston & Reens LLC

[57] ABSTRACT

A packaged egg omelet mix facilitates preparation of omelets by microwave heating. An upper container portion holds an omelet inlay, such as cheese, diced vegetables and diced meat, and has a cylindrical body and an upper end wall. A lower container portion also has a cylindrical body and encloses a sealed container holding an aseptically-packaged liquid egg. The omelet is prepared by depositing the liquid egg and omelet inlay into the lower container portion, and placing the lower container portion in a microwave oven for heating.

9 Claims, 2 Drawing Sheets

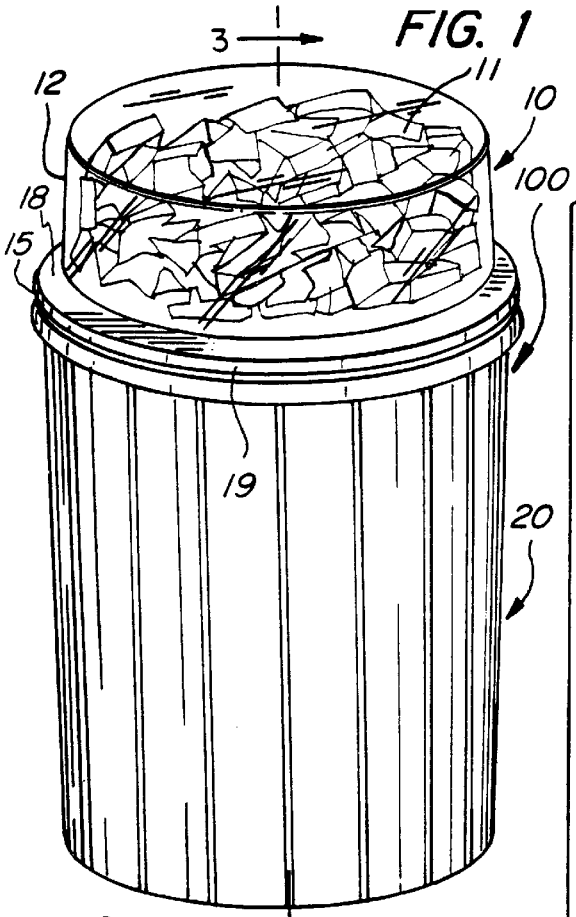
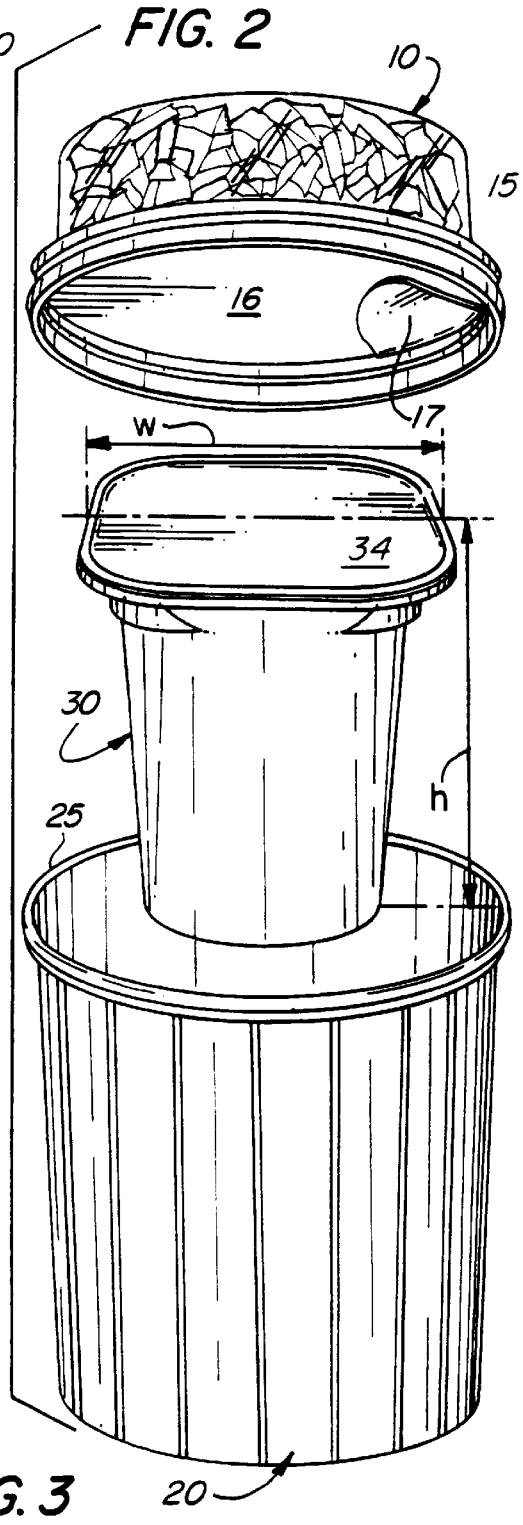
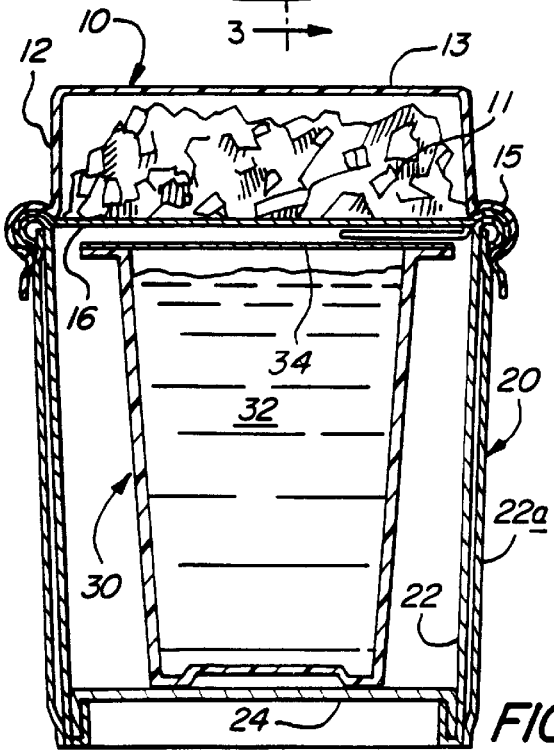
FIG. 3

PROCESS FOR STORING AND COOKING AN OMELET

This is a divisional of application Ser. No. 08/512,692, filed on Aug. 10, 1995, now U.S. Pat. No. 5,674,546.

TECHNICAL FIELD

The invention relates to omelets, and particularly to a package and a process which enable long term, refrigerated temperature storage of a ready-to-use omelet mix and simplified preparation of an omelet microwave heating in the storage container.

Omelets have long been favorites but traditionally require fresh eggs, fresh ingredients such as-cheese, vegetables, meat or other ingredients to form flavorful inlays, and proper cooking utensils. Despite their appeal, omelets are not widely perceived as an impulse or snack food like yoghurt pudding or frozen desserts, possibly because modem food technology has provided so many other good-tasting and convenient alternatives.

Omelet preparations have been available in the form of frozen mixes, reconstitutable mixes containing dried eggs, and fully prepared frozen omelets. However, each of the forms available suffers from some degree of degradation in flavor and/or texture. For example, dried eggs which need reconstitution often develop off flavors during storage and typically lose the desired egg texture. Also, frozen vegetables suffer textural loss becoming flaccid and lacking in turgidity. Frozen foods are also difficult to heat uniformly unless the time is taken to thaw them first There is a present need for a convenient egg omelet preparation which can offer the consumer a good-tasting omelet with a minimum of planning and preparation.

BACKGROUND ART

The art has provided a wide variety of egg preparations including liquid, dried and frozen forms. And the art has suggested cooking them with the many heating devices available including radiant heat, conductive heat by frying, and microwave heating. Yet further, the art has provided an extensive array of packaging and cooking devices, sometimes permitting the package to double as the cooking utensil. The art has failed, however to provide any combination of these technologies which can provide the consumer with a high level of convenience and quality in omelet preparation.

In U.S. Pat. No. 3,565,638, Ziegler, et al, describe the preparation of a frozen egg product which can contain various inlay materials frozen with the egg to provide frozen omelet mix. Unfortunately, totally frozen mixes, this type can present several difficulties. First, they require thawing prior to preparation. This is time consuming and shortens the storage life of the product. In U.S. Pat. No. 4,910,036, Rapp discloses that if no precaution is taken, added vegetables can contaminate the product. Such contamination would further shorten the storage life of the product after thawing. Freezing is also a problem from the standpoint of vegetable texture—typically causing destruction of crispness, even more than normal when mixed with the egg prior to freezing because the formation of large ice crystals cannot be avoided.

Another problem with frozen foods containing significant amounts of liquids—in addition to the long time periods for thawing—is uneven heating. Conventional heating, which requires conducting heat from the outside in, does not thaw the food evenly. And microwave heating has other problems. In U.S. Pat. No. 5,077,066, Mattson, et al. disclose that the thawing process cannot be easily expedited by microwave heating because microwave heating tends to be uneven due to differential microwave absorptivities and uneven distributions. To remedy this, they disclose a packaged frozen food product adapted for heating by microwave oven utilizing an essentially dry sauce component along with a quantity of frozen food constituents. The food is prepared for serving by mixing water into the frozen food constituents to liquefy the sauce, and then heating by microwave energy. The addition of the water in this manner obviates the need to thaw the sauce. The Mattson, et al. disclosure does not address the problems of egg compositions.

One commercial egg omelet mix (OMELET MASTER™, available from Hormel Foods Corporation) employs a dry mix of egg solids and dried vegetables which is rehydrated in a special container, and poured into a tray for heating in a microwave oven. In at least one form of the product, a container for the egg solids and the vegetables and one for an additional cheese mix are nested in the tray which is over wrapped with a paperboard sleeve. This product, like that of Mattson, et al., avoids the need to thaw large amounts of water, but does this at the expense of taste and texture.

The characteristic of microwave energy to heat unevenly has been utilized by some technologists to their advantage for differentially heating certain frozen foods such as ice cream sundaes. For example, Slangan, et al., in U.S. Pat. No. 4,233,325, describe a multi-compartment package for a frozen confection and a sauce, which permits the sauce to be heated in a microwave oven while the confection stays frozen. Once heated, the sauce is poured onto the frozen confection. And in U.S. Pat. No. 4,874,618, Seabome, et al., describe a similar concept, but employ an edible partition between upper and lower compartments which can be ruptured with a spoon just before consumption. While whole eggs exhibit the tendency for the yolk to heat more rapidly than the white when heated by microwave energy, the preparation of eggs is not discussed.

In U.S. Pat. No. 4,883,935 Fairchild et al., also address differential heating of composite food products, but from the standpoint of a container adapted for storing distinct foods prior to microwave heading. A multi-part container is described, having upper and lower sealed compartments for separately containing foods which are processed and packaged separately. To prepare the foods for serving, both containers are opened, the contents of the upper container are added to the lower container; the upper container is placed over the lower container, and the combined contents are subjected to microwave heating. The containers are not designed to enable the storage or preparation of egg products.

It remains that the art has failed to provide a convenient egg omelet preparation which can offer the consumer a good-tasting omelet with a minimum of planning and preparation. The art has failed, further, to enable combination of the known technologies in a manner which provides consumers with an omelet preparation offering a high level of convenience and quality.

DISCLOSURE OF INVENTION

It is an object of the invention to provide a convenient egg omelet preparation which can offer the consumer a god-tasting omelet with a minimum of planning and preparation:

It is another object of the invention to enable the combination of the known technologies to provide the consumer with a high level of convenience and quality in an omelet preparation;

These and other objects are achieved according to the invention which provides a packaged egg omelet mix, a method for packaging the mix and a method for preparing an egg omelet by microwave heating.

In a preferred form, the packaged egg omelet mix comprises: an upper container having a cylindrical body comprised an upper side wall, an upper end wall connected to said upper side wail, and an upper sealing flange connected to said upper side wall opposite said upper end wale said upper container containing an omelet inlay comprising at least one food ingredient in discrete pieces a lower container having a lower cylindrical body comprised of a lower side wall, a lower end wall, and a lower sealing edge connected to said lower side wall opposite said lower end wall, and a sealed container holding an aseptically packaged liquid egg product capable of maintaining the egg suitable for consumption for at least 30 days under refrigerated storage, said sealed container being positioned with said lower container, and said upper container and said lower container being joined with said upper sealing flange in contact with said lower sealing edge.

Preferably, said omelet inlay will comprise a member selected from the group consisting of grated cheese, diced vegetables, diced meat, and a combination of two or more of these, and said egg will comprise a low-cholesterol egg composition consisting essentially of egg albumen with minor amounts of coloring and salts.

In one embodiment, said upper container further includes a heat sealable foil or film contacting said upper sealing flange to thereby enclose said omelet inlay within said upper container. In another embodiment, said upper container further includes a sealed package enclosing said omelet inlay in this latter embodiment, said upper end wall preferably includes vent holes to facilitate release of steam generated during microwave heating. For both embodiments, said lower side wall preferably includes a layer of insulating material to protect the consumer's hand following heating in a microwave oven. Preferably, said upper sealing flange comprises an annular portion which extends outwardly from said upper side wall and a cylindrical portion, concentric with the upper side wall and extending downwardly from said annular portion. It is also preferred that said upper sealing flange is configured to snap over said lower sealing edge.

The method of the invention for packaging an egg omelet mix in a manner which facilitates preparation by microwave heating, comprises, pasteurizing a liquid egg composition; aseptically packaging the liquid egg composition in a sealed egg container to maintain the egg suitable for consumption for at least 30 days under refrigerated storage; placing said sealed egg container in a lower container having a lower cylindrical body comprised of a lower side wall, a lower end wall, and a lower sealing edge connected to said lower side wall opposite said lower end wall, covering said lower container with an upper container having a cylindrical body comprised of an upper side wall, an upper end wall connected to said upper side wall, and an upper sealing flange connected to said upper side wall opposite said upper end wall, said upper container containing an omelet inlay comprising at least one food ingredient in discrete pieces; and joining said lower container and said upper container to hold said upper sealing flange in contact with said lower sealing edge;

BRIEF DESCRIPTION OF THE DRAWINGS

The invention will be better understood and is advantages will become more apparent from the following detailed description especially when read in light of the accompanying drawings, wherein;

FIG. 1 is a perspective view of a preferred embodiment of the invention, wherein an omelet mix is packaged in a composite package including an upper container which is shown enclosing an omelet inlay material and attached to and overlying a lower container, which as will be described, holds a packaged liquid egg product and can function as the cooking vessel for the omelet;

FIG. 2 is an exploded view showing the several components of the packaged omelet mix illustrated in FIG. 1.

FIG. 3 is a cross-sectional view, taken along line 3—3 in FIG. 1.

INDUSTRIAL APPLICABILITY

Figure 4:
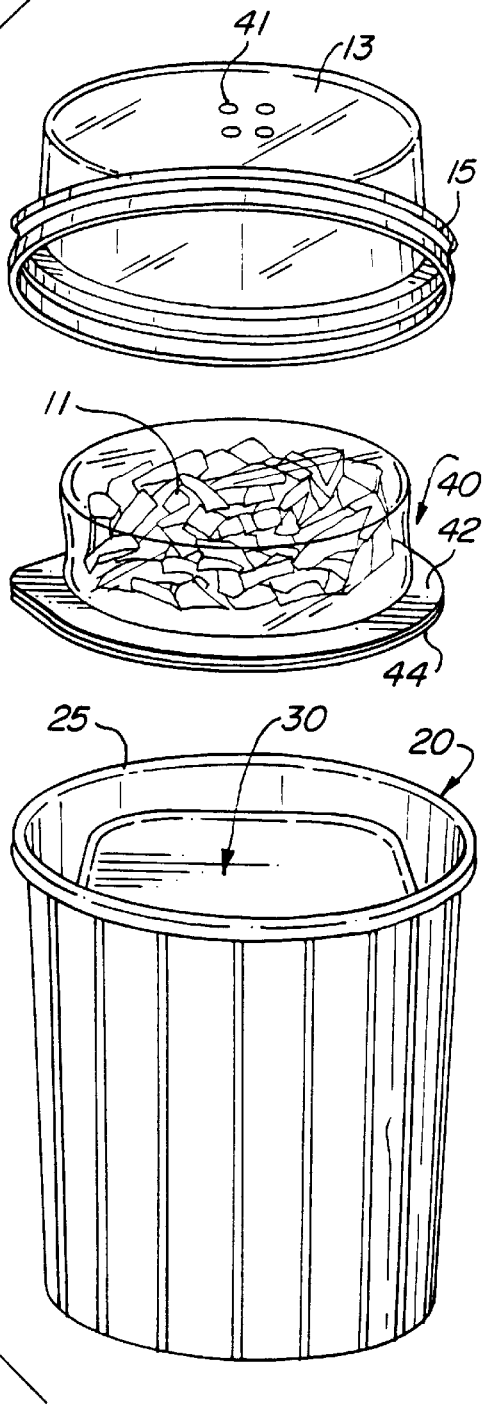
FIGS. 4 and 5 are exploded views depicting alternative embodiments

The invention will be described below with specific reference to a preferred embodiment wherein a preferred structure, of the type shown in FIGS. 1–3, is described in detail. The alternative embodiments of the other figures will then be described with reference to that of FIGS. 1–3, describing the variations of structure as necessary for the person skilled in the art to produce them without recitation of unnecessary detail. The drawings show the various features for clarity of illustration and are not meant to limit the invention to the exact dimensions of individual parts or even their size in relation to the others.

FIG. 1 shows a perspective view of a preferred embodiment of the invention, wherein an omelet mix is packaged in a composite package 100. The composite package 100 includes an upper container 10 which is shown enclosing an omelet inlay material 11. The upper container 10 is attached to and overlies a lower container 20 which, as will be described, holds a packaged liquid egg product and can function as the cooking vessel for the omelet. Reference to FIG. 2 reveals an exploded view showing the several components of the packaged omelet mix illustrated in FIG. 1. In this view, an egg container 30 can be seen.

The cross-sectional view of FIG. 3 shows upper container 10 holding an omelet inlay 11. The omelet inlay 11 can be any suitable food material, preferably cut into pieces and packed in a manner effective to assure stability under refrigerated conditions for at least as long as the egg component which is typically the most difficult to stabilize of all of the foods contemplated for the omelet mix. The inlay will preferably comprise a member selected from the group consisting of grated cheese, diced vegetables, diced meat, and a combination of two or more of these.

It is an advantage of the invention that the inlay materials are maintained separate from the egg component and need not be processed to the extent that is required for the egg material. The inlay materials can be packaged with a minimum amount of heating and texture degradation. For example, in the case of vegetables, simple blanching and rinsing of spraying with a suitable antimycotic, such as sodium or potassium sorbate; will be effective. Similarly, while meat components are typically fully cooked and cheese is typically grated, they can be packaged with minimal treatment. It is to be understood, however, that more aggressive treatments can be employed, such as infusion of drying, with or without the addition of salts, acids, or sugars; to bring the moisture content down to within the range of from about 25 to about 65% by weight, and to achieve a water activity of from about 0.35 to about 0.85, e.g., from about 0.45 to about 0.65. if desired, the techniques of U.S.

Pat. No. 4,910,036 to Rapp can be employed to prepare aseptically packaged vegetables in a sauce. The disclosure of the Rapp patent is incorporated by reference.

The egg will comprise any liquid egg which is processed to be sufficiently refrigerator stable to provide a practical commercial product. Typically, the egg composition will contain egg (either whole egg or albumen alone) with minor amounts of stabilizers, coloring and salts for flavor, functionality and/improved heat processing as taught by Lineweaver, et al. in U.S. Pat. No. 3,251,697. Suitable compositions are disclosed in the above Rapp patent as well as U.S. Pat. No. 3,911,144 to Strong, et al., and U.S. Pat. No. 5,266,338 to Cascione and Rapp.

For the purposes of this invention, the term "refrigerator stable" means that the food product, whether it be the egg or inlay component, will remain microbiologically stable and suitable for consumption for at least 30 days (preferably 90 days) under refrigerated storage, e.g., storage in unfrozen condition at a temperature of from about 0° to about 10°C. (preferably about 2° C.). In the case of the liquid egg product; the population of spoilage organisms (e.g., *Streptococcus faecalis*) should be reduced by a factor of at least "seven log cycle" (7D), i.e., the number is reduced at least 99.99999%, and the population of viable Salmonella organisms should be reduced by a factor at least "nine log cycle" (9D) i.e., the number is reduced at least 9.9999999%.

Among the processes suitable for achieving the desired degree of stability are those described, for example in U.S. Pat. No 5,266,338 to Cascione and Rapp, in the case of low-cholesterol eggs, and U.S. Pat. No. 4,808,425 to Schwartzel, et al., in the ease of whole eggs. The complete disclosures of these patents, including the documents referenced therein, are hereby incorporated by reference. Preferably, the liquid egg will comprise a low-cholesterol egg composition consisting essentially of egg albumen with minor amounts of coloring, stabilizers and salts, such as prepared according to the above referenced disclosure of Cascione and Rapp or the disclosure of Rapp in U.S. Pat. No. 5,096,728. Once prepared, the liquid egg is preferably aseptically packaged in a suitable process such as through, the use of a Hamba aseptic packager, produced by Hamba Machinen Fabrik of Neunkirchen, Germany.

In a preferred form, the upper container 10 has a cylindrical body comprised of an upper side wall 12, an upper end wall 13 connected to the upper side wall, and an upper sealing flange 15. The figures show the upper sealing flange 15 connected to the upper side wall 12 at the end opposite the upper end wall 13. The upper container 10 is shown in FIGS. 1–3 to contain an omelet inlay 11 comprising at least one food ingredient in discrete pieces. In the case of cheeses, it is preferred to flush the container 10 with a gas—such as a mixture of nitrogen and carbon dioxide—to inhibit mold growth. Preferred ratios of nitrogen to carbon dioxide will be in the range of from about 3:1 to 5:1. e.g., about 4:1. The oxygen level in the container is preferably less than about 1.5%. The inlay 11, is seated within the upper container 10 by virtue of sealing foil 16 which is adhered to upper sealing flange 15. The foil 16 will preferably be adhesivly adhered, to provide a tight, but releasable seal The foil 16 is shown in FIG. 2 to be formed with tab 17 permit easy removal to open the upper container 10. The foil 16 can be of any suitable material, such as metal foil, polymeric foil or a composite of metal foil and polymer. Metalized polyethylene-terephthalate is representative of the suitable polymeric foils, and composites of aluminum and polyethylene are representative of the composite type foils. Preferably, the upper container itself will be made of a suitable polymeric material, such as polyethylene-terephthalate, polyvinyl chloride or modified polystyrene blends, by a suitable process such as vacuum forming.

The lower container 20 is shown to have a lower cylindrical body comprised of a lower side wall 22, a lower end wall 24, and a lower sealing edge 25. The lower sealing edge 25 is connected to the lower side wall 22 opposite the lower end wall 24. The tower side wall 22 preferably includes a layer of insulating material 22*a* to protect the consumer's hand following heating in a microwave oven. The layer of insulating material 22*a*, is shown to be a corrugated layer of paperboard alternately sealed to and raised from the surface of an inner ply of similar paperboard which forms the inner surface of the side wall 22 of lower container 20. Foamed plastic or other insulating materials can also be employed. The paperboard is preferably coated with a suitable polymeric coating to render the paperboard moisture resistant. Paperboard polymer laminates of this type typically have a paperboard layer, such as bleached sulfite paperboard stock (e.g., 100 to 150 pounds per 1000 square feet), preferably with al coating (e.g., about 0.7 mils) of a polymer (e.g., polyethylene) adhered thereto. Preformed containers of the type shown are commercially available from Sherry Cup, Inc. and California Environmental Cup. The lower container portion can also be made of a suitable foamed plastic, such as polystyrene having a density of from about 0.9 to about 1.3 pounds per cubic foot.

While the upper and lower containers are defined as having cylindrical bodies, those skilled in the packaging art will understand that deviations from true cylindrical shape can be permitted. For example, rounded square or rectangular, as well as other out-of-round, shapes can be effectively employed.

FIGS. 2 and 3 show a sealed egg container 30, holding an aseptically-packaged liquid egg product 32, positioned within said lower container 20. The egg container is sealed by foil 34. The foil 34 can be of a type similar to the foil 16 which is employed to seal the upper container 10. The preferred type of container 30 is a 145 ml, rounded-square cross section made of polypropylene copolymer and having dimensions of about 67 mm high (h, in FIG. 2) by 67 mm cross the top center parallel to a side (w, in FIG. 2).

The upper contained 10 and the lower container 20 are joined with the upper sealing flange 15 in contact with said lower sealing edge 25. In the preferred form of the invention, means (not shown) are provided to hold these containers in mated relation. A simple adhesive tape can be employed, as can a paperboard sleeve. Preferably, the upper sealing flange 15 on upper container 10 comprises an annular portion 18 which extends outwardly from the upper side wall and a cylindrical portion 19, concentric with the upper side wall 12, which extends downwardly from the annular portion 18. It is preferred that upper sealing flange 15 has a configuration similar to that shown to snap over said lower sealing edge 25 on the lower container 20.

In the embodiment of FIGS. 1 through 3, the upper container 10 is shown to include a foil 16 adhered to the upper seating flange 15 to thereby enclose the omelet inlay 11 within the upper container 10. In another embodiment, shown in FIG. 4, the upper container 10 includes a sealed package 40 enclosing the omelet inlay 11. The upper end wall 13 preferably includes vent holes 41 to facilitate release of steam generated during microwave heating. Package 40 has a sealing flange 42 to which is adhered a sealing foil 44 which can be of the type discussed above.

Figure 5:
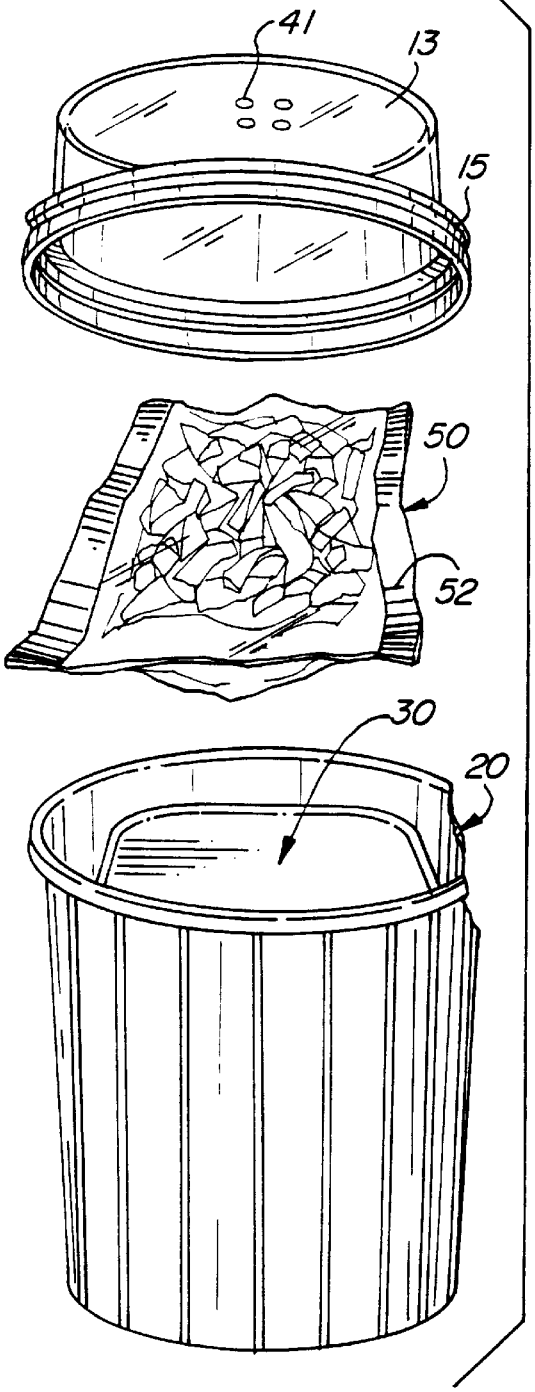

The embodiment of FIG. 5 is similar to that of FIG. 4 except that a separate inlay package 50 is provided, having a peripheral seal 52 to maintain the inlay 11 protected during storage.

To prepare the egg omelet according to the invention, the sealed egg container 30 which is positioned within the lower container 20, is removed therefrom and opened. The liquid egg product is then poured into the lower container. The upper container is then opened and the omelet inlay are then emptied into lower container. The lower container and its contents are then subjected to microwave energy for a time sufficient to cook the egg, e.g., for from about 90 to about 120 seconds utilizing a 700 watt microwave oven for an omelet containing from about 130 to about 150 grams total weight, with a weight ratio of egg to inlay of from about 5:1 to about 1:1. Times will of course vary with the total volume of ingredients and the type of oven.

The above description is intended to enable the person skilled in the art to practice the invention, it is not intended to detail all of the possible modifications and variations which will become apparent to the skilled worker upon reading the description. It is intended, however, that all such modifications and variations be included within the scope of the invention which is defined by the following claims. The claim are meant to cover the indicated elements and steps in any arrangement or sequence which is effective to meet the objectives intended for the invention, unless the context specifically indicates the contrary.

We claim:

1. A method of packaging an egg omelet mix in a manner which facilitates preparation by microwave heating, comprising:

providing an upper container having a body comprised of an upper side wall, an upper end wall connected to said upper side wall, and an upper sealing flange connected to said upper side wall opposite said upper end wall;

placing an omelet inlay in said upper container, said omelet inlay comprising at least one food ingredient in discrete pieces;

providing a lower container having a lower body comprised of a lower side wall, a lower end wall, and a lower sealing edge connected to said lower side wall opposite said lower end wall;

sealing a liquid egg product in an egg container, said liquid egg product being aseptically packaged in said sealed egg container and said sealed egg container being capable of maintaining the egg suitable for consumption for at least 30 days under refrigerated storage;

positioning said sealed egg container within said lower container; and joining said upper container containing said omelet inlay and said lower container containing said sealed egg container with said upper sealing flange in contact with said lower sealing edge said sealed egg container being removable from said lower container so that the sealed egg container can be opened and its contents poured back into said lower container and wherein said lower container is dimensioned to receive both the contents of the egg container and the omelet inlay and wherein said lower container is microwaveable.

2. A method according to claim 1 wherein said upper container further includes a film contacting said upper sealing flange to thereby enclose said omelet inlay within said upper container.

3. A method according to claim 1 wherein said upper container further includes a sealed package enclosing said omelet inlay.

4. A method according to claim 1 wherein said upper sealing flange comprises an annular portion which extends outwardly from said upper side wall and a portion, concentric with the upper side wall, extending downwardly with respect thereto from said annular portion and said upper sealing flange is configured to snap over said lower sealing edge.

5. A method according to claim 1 wherein said upper end wall includes vent holes and said lower side wall includes a layer of insulating material.

6. A method according to claim 1 wherein said omelet inlay comprises a member selected from the group consisting of grated cheese, diced vegetables, diced meat, and a combination of two or more of these, and said egg comprises a low-cholesterol egg composition consisting essentially of egg albumen with minor amounts of coloring and salts.

7. A method for preparing an egg omelet by microwave heating, comprising:

providing a packaged egg omelet mix comprising an upper container containing an omelet inlay comprising at least one food ingredient in discrete pieces, and a lower container holding a sealed egg container wherein said sealed egg container contains an aseptically-packaged liquid egg product capable of maintaining the egg suitable for consumption for at least 30 days under refrigerated storage and wherein said upper container and said lower container are secured to each other;

removing said sealed egg container from said lower container; opening said sealed egg container and pouring said liquid egg product into said lower container;

opening said upper container and emptying the omelet inlay into the liquid egg product held within said lower container; and then subjecting said lower container and its contents to microwave energy for a time sufficient to cook the egg omelet.

8. A method according to claim 7 wherein said omelet inlay comprises a member selected from the group consisting of grated cheese, diced vegetables, diced meat, and a combination of two or more of these, and said egg comprises a low-cholesterol egg composition consisting essentially of egg albumen with minor amounts of coloring and salts.

9. A method according to claim 7 wherein said upper container further includes a sealed package enclosing said omelet inlay and said upper container includes vent holes, and said lower container includes a layer of insulating material.

* * * * *